US005781967A

United States Patent [19]

Domenig et al.

[11] Patent Number: 5,781,967

[45] Date of Patent: Jul. 21, 1998

[54] SELF MOUNTING ADJUSTABLE HINGE WITH D-SHAPED OPENING

[75] Inventors: Georg Domenig; Andreas Moser, both of Kernersville, N.C.

[73] Assignee: Grass America, Inc., Kernersville, N.C.

[21] Appl. No.: 658,734

[22] Filed: Jun. 5, 1996

[51] Int. Cl.[6] ..... E05D 7/04

[52] U.S. Cl. ..... 16/249

[58] Field of Search ..... 16/249, 235

[56] References Cited

U.S. PATENT DOCUMENTS 4,506,409 3/1985 Lautensclager ..... 16/249
5,375,297 12/1994 Lautenschlager et al. ..... 16/249

FOREIGN PATENT DOCUMENTS 874268 8/1942 France ..... 16/249
183387 7/1922 United Kingdom ..... 16/249

*Primary Examiner*—Chuck Mah
*Assistant Examiner*—Donald M. Gurley
*Attorney, Agent, or Firm*—Kilpatrick Stockton; John M. Harrington

[57] ABSTRACT

An improved self mounting adjustable hinge which simplifies the pre-installation of a door on a frame resulting in greater efficiency and reduced costs associated with the production of furniture articles such as cabinets, desks and the like. The improved adjustable hinge includes a hinge cup mountable to a door, a hinge arm connected at one end to the hinge cup and a hinge plate connected to the other end of the hinge arm which includes a substantially D-shaped opening for mounting the hinge plate to the frame and securing the door to the frame. The D-shaped opening in the hinge plate is specifically dimensioned to allow a head of a pre-installed fastening screw to pass through the opening only when the hinge plate is tilted relative to the screw head.

14 Claims, 2 Drawing Sheets

SELF MOUNTING ADJUSTABLE HINGE WITH D-SHAPED OPENING

BACKGROUND OF INVENTION

1. Field of Invention

The subject invention is generally related to adjustable furniture hinges and is specifically directed to a self mounting adjustable hinge for mounting a door on a frame which includes a hinge plate with a substantially D-shaped opening for quickly and easily affixing the hinge plate and door to the frame.

2. Description of the Prior Art

Adjustable hinges are known in the art and are typically affixed to a door at one end and a supporting frame at the other end by fastening screws. One type of adjustable hinge includes a hinge cup which is mounted in a hinge cup bore hole in a door and a hinge plate which is subsequently mounted on a supporting frame. For affixing the hinge plate to the frame, the prior art hinge plate is provided with a single slotted hole which enables adjustment of the position of the mounted hinge plate relative to the frame. Thus, an advantage of the adjustable hinge is that the door may be repositioned for alignment with the frame after it has been hung on the frame by vertically moving the hinge plate the length of the slotted hole. Once the proper positioning is determined, the fastening screw is tightened. Examples of various types of adjustable furniture hinges are shown in my U.S. Pat. Nos. 5,485,656 and 5,414,896 and in U.S. Pat. No. 5,375,297.

In an assembly line for the production of furniture articles, such as desks or cabinets, after first mounting the hinge cup to the door, it is typical for one worker to hold the hinge plate and supported door in position on the frame while another worker inserts a fastening screw into a pre-drilled hole so that the door is connected to the frame in a pre-mounting position. Then, in another step, the fastening screw is tightened to mount the door on the frame. This process is time consuming and requires more than one worker to accomplish. Various solutions to increasing the efficiency of this process and thus reducing the costs of furniture production have been tried. For example, some prior art adjustable hinges include a hinge plate opening connected to a side entry channel for receiving the screw shaft of a pre-installed screw or include a hinge plate with anchoring legs. However, there may be an increased cost of modifying the hinge as such and the efficiency of the process may not be substantially increased.

Therefore, there is a need for an improvement in this type of furniture hinge which permits the hinge to be installed with substantially increased efficiency and reduced costs.

SUMMARY OF THE INVENTION

The subject invention is directed to an improved self mounting adjustable hinge for pre-installation of a door on a frame with substantially increased efficiency and reduced costs associated with the production of furniture articles such as cabinets, desks and the like. The improved adjustable hinge includes a hinge cup mountable to a door, a hinge arm connected at one end to the hinge cup and a hinge plate connected to the other end of the hinge arm which includes a substantially D-shaped opening for mounting the hinge plate to the frame and securing the door to the frame.

The D-shaped opening in the hinge plate of the subject invention is specifically dimensioned to allow a head of a pre-installed fastening screw to pass through the opening only when the hinge plate is tilted relative to the screw head. Because of the unique configuration of the D-shaped opening, the hinge plate will not fall off the screw once the screw head has been inserted through the opening and can only be removed by tilting the plate in the same manner it was tilted to initially allow the screw head to pass through. Thus, in an assembly line, the hinge plate and supported door is simply hung on the extending shaft portion of a pre-installed screw, which is at first only partially driven into the frame, by slightly tilting the hinge plate relative to the screw head and slipping the screw head through the D-shaped opening. The hinge plate is then securely affixed to the frame by tightening the fastening screw.

In the past, it was necessary for one person to support the door in position with the hinge plate on the frame while another person placed the fastening screw through a hole in the hinge plate and into a pre-drilled screw hole and then drove the screw into the frame to fasten the hinge plate to the frame. While some of the prior art adjustable hinges have addressed this problem by providing hinges with a hinge plate opening connected to a side entry channel for receiving the screw shaft or hinge plates with anchoring legs, none of the prior art discloses a hinge plate having a substantially D-shaped opening for receiving the screw head of a pre-installed fastening screw. The improved adjustable hinge of the subject invention permits a single worker to hang the hinge plate and supported door on a partially driven screw on the frame in a pre-mounted position and then affix the hinge plate to the frame by tightening the fastening screw with no assistance necessary.

In addition to permitting pre-installation of a door on a frame by a single worker, the subject invention includes all of the advantages of the prior art adjustable hinges. That is, the length of the D-shaped opening is larger than the screw shaft which permits adjustment or repositioning of the pre-mounted hinge plate and supported door in the vertical direction to adjust the height of the door after the door is hung on the frame but prior to tightening the fastening screw. While the length of the opening is larger than the screw shaft, the substantially D-shaped opening has a width which is smaller than the diameter of the screw head and slightly larger and substantially equal to the diameter of the screw shaft. Thus, the pre-mounted hinge plate is not moveable in a horizontal direction and, when tightened, the fastening screw securely affixes the hinge plate to the frame.

The subject invention is directed to an adjustable hinge with a pre-mounting feature which simplifies the procedure for mounting a door on a frame for increased efficiency of production. In order to install the adjustable hinge, for example in a cabinet, the hinge is first mounted on a cabinet door by affixing the hinge cup in a pre-drilled bore hole on the inside of the door proximate a lateral edge of the door. The cabinet frame is presented in a horizontal position with the cabinet door opening facing upward and a fastening screw driven part-way into a pre-drilled screw hole in the cabinet frame with the screw head and a portion of the screw shaft extending above the surface of the frame. With the cabinet frame so positioned, the hinge plate of the subject invention is simply hung on the extending portion of the screw shaft by slightly tilting the hinge plate relative to the screw head and slipping the screw head through the D-shaped opening. The hinge plate and supported door are then securely affixed to frame by simply tightening the fastening screw. Because the D-shaped opening is dimensioned to allow the screw head to pass through the opening only when the hinge plate is tilted, once the hinge plate is positioned with the screw through the opening, the plate remains on the fastening screw without the danger of accidently falling off and is securely affixed when the fastening screw is tightened. Moreover, the unique D-shaped opening allows vertical adjustment of the pre-mounted hinge plate relative to the frame prior to tightening the fastening screw. Thus, in a cabinet making assembly line, a single worker can hang the hinge plate on the frame, vertically adjust the position of the hinge plate and securely affix the door to the frame by tightening the fastening screw, with no assistance necessary.

Therefore, it is an object and feature of the subject invention to provide an improved self mounting adjustable hinge which simplifies the procedure for mounting a door on a supporting frame resulting in greater efficiency and reduced costs.

It is a further object and feature of the subject invention to provide an improved adjustable hinge having a hinge plate with a substantially D-shaped opening for receiving a screw head of a pre-installed fastening screw.

It is another object and feature of the subject invention to provide an improved adjustable hinge having a substantially D-shaped opening in the hinge plate which is specifically dimensioned to allow a head of a pre-installed fastening screw to pass through the opening only when the hinge plate is tilted relative to the screw head.

It is yet another object and feature of the subject invention to provide an improved adjustable hinge having a substantially D-shaped opening in the hinge plate which is dimensioned to permit vertical adjustment of the hinge plate prior to tightening the fastening screw.

It is a further object and feature of the subject invention to provide an improved adjustable hinge having a substantially D-shaped opening in the hinge plate with a width which is less than the diameter of the screw head of the fastening screw such that tightening the fastening screw securely affixes the hinge plate to the frame.

DETAILED DESCRIPTION OF THE DRAWINGS

Figure 1:
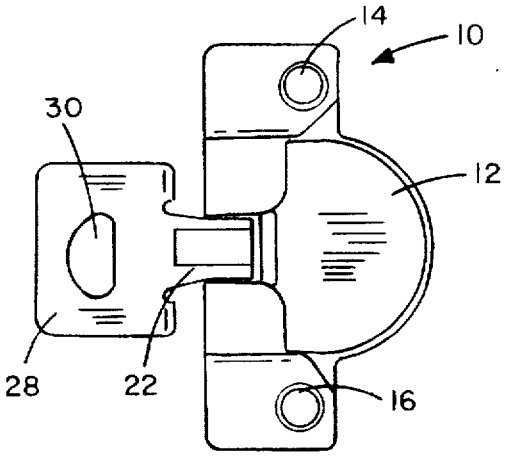
FIG. 1 is an overhead view of an improved, self mounting adjustable hinge having a hinge cup, hinge arm and hinge plate and including a substantially D-shaped opening in the hinge plate.
Figure 2:
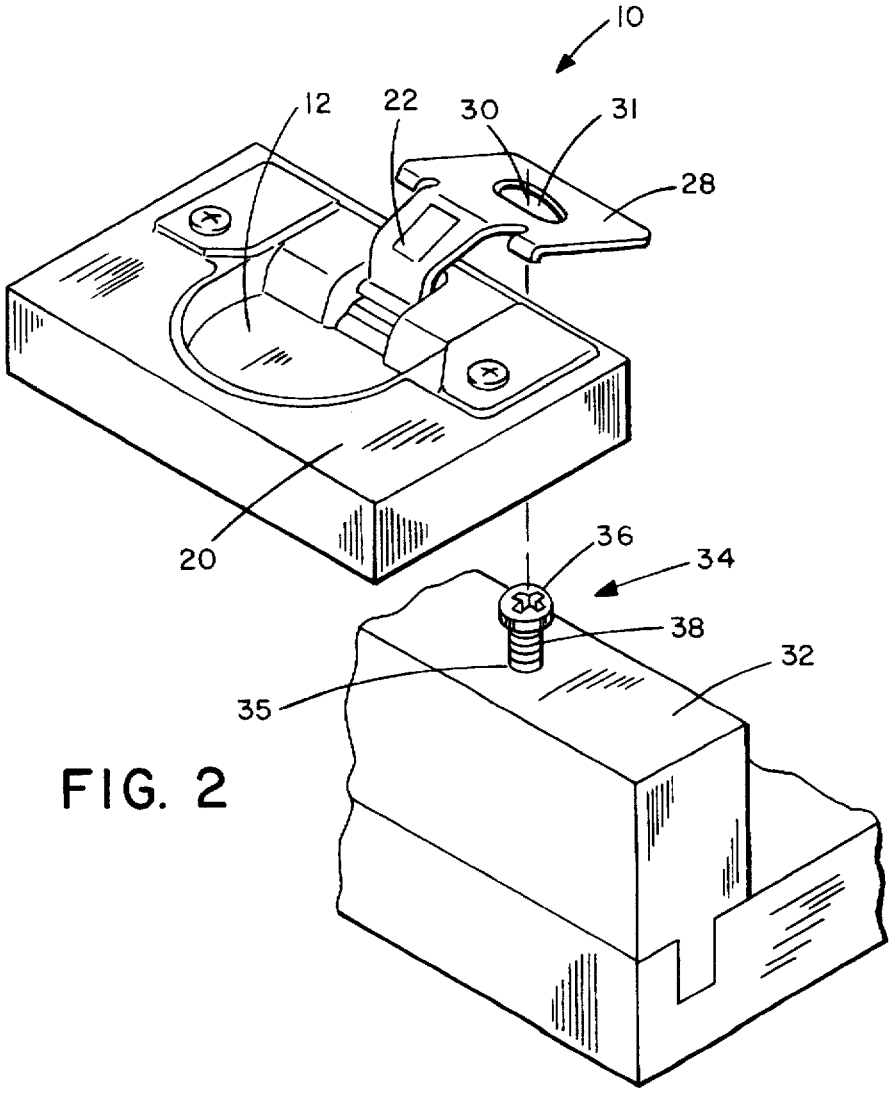
FIG. 2 is a perspective view of the improved adjustable hinge illustrating the D-shaped opening in the hinge plate positioned over a screw head of a fastening screw pre-installed on a frame illustrating the hinge plate being tilted for passing the screw head through the D-shaped opening.
Figure 3:
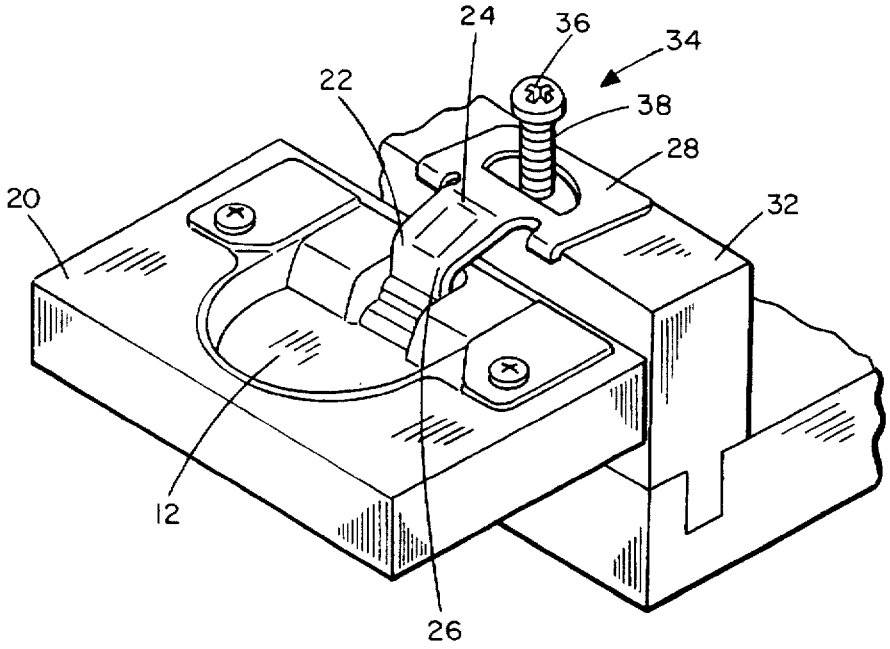
FIG. 3 is a perspective view of the hinge plate hung on a partially driven fastening screw on the frame and moveable for vertical adjustment of the hinge plate.

Referring to FIGS. 1–5, the improved self mounting adjustable hinge is designated generally by the reference numeral 10 and comprises a hinge cup 12 having openings 14, 16 for mounting the hinge cup on a door 20, a hinge arm 22 connected at one end 24 to the hinge cup 12 and a hinge plate 28 connected to the other end 26 of the hinge arm 22. As shown, the subject invention includes a substantially D-shaped slot or opening 30 in the hinge plate 28 for mounting the hinge plate 28 to a supporting frame 32, such as a cabinet frame around the door opening, and securing the door 20 to the frame 32. The subject invention is specifically directed to an improved self mounting adjustable hinge 10 for pre-installation of a door, such as a cabinet door, on a cabinet frame with greater efficiency and reduced costs associated with the production of furniture articles such as cabinets, desks and the like.

Prior to installation on the frame, the hinge 10 is first mounted on the door 20 by inserting screws into openings 14, 16 and affixing the hinge cup 12 in a pre-drilled bore hole on the inside of the door proximate a lateral edge of the door (not shown). Also prior to installation on the frame, a fastening screw 34, having a screw head 36 and a screw shaft 38, is driven part way into a pre-drilled screw hole 35 in the frame 32 with the screw head 36 and a portion of the screw shaft 38 extending above the surface of the frame 32 (see FIG. 2). The substantially D-shaped slot or opening 30 in the hinge plate 28 of the subject invention is specifically dimensioned to allow the head 36 of the pre-installed fastening screw 34 to pass through the opening 30 only when the hinge plate 28 is tilted relative to the screw head 36. In other words, the width W of the D-shaped slot or opening 30 is less than the diameter of the screw head 36 (see FIGS. 4 and 5). Thus, when the hinge plate 28 is presented in a horizontal position relative to the screw head 36, the screw head 36 can not pass through the D-shaped opening 30. However, by tilting the hinge plate 28 relative to the screw head 36, a pass through entry opening 31 in the D-shaped slot 30 is defined and the screw head 36 of the pre-installed fastening screw 34 easily passes therethrough.

The improved adjustable hinge 10 of the subject invention simplifies the procedure for mounting a door on a frame by eliminating the need for one person to hold the hinge plate and supported door in position while another person inserts the fastening screw through an opening in the hinge plate and into a pre-drilled screw hole in the frame. The improved adjustable hinge 10 permits a single worker to hang the hinge plate 28 and supported door 20 on a fastening screw 34 partially driven into a frame 32 and then, securely affixing the hinge plate 28 thereto.

Figure 4:
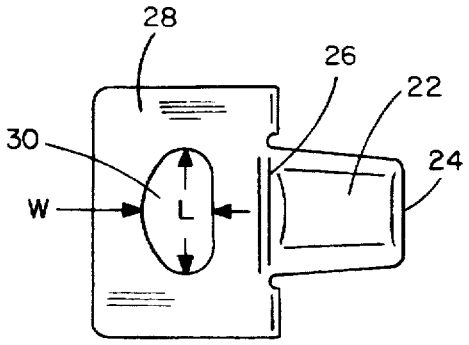
FIG. 4 is an overhead view of the hinge plate showing the width and length of the D-shaped opening.
Figure 5:
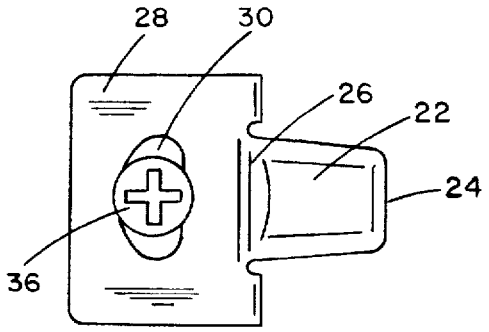
FIG. 5 is an overhead view of the hinge plate with the fastening screw tightened to securely affix the door to the frame.

In addition to simplifying the procedure for mounting a door on a frame, the substantially D-shaped opening 30 of the improved adjustable hinge 10 enables adjustment of the position of the affixed hinge plate 28 relative to the frame 32. Once the hinge plate 28 is hung on the pre-installed fastening screw 34, the adjustable hinge 10 and supported door 20 are in a pre-mounted position (see FIG. 3). As shown in FIGS. 4 and 5, the length L of the D-shaped opening 30 is larger than the screw shaft 38 for vertically adjusting or repositioning the pre-mounted hinge plate 28 lengthwise along the D-shaped opening 30 to vertically align the door with the frame prior to tightening the fastening screw. While the pre-mounted adjustable hinge 10 can be vertically adjusted, the width W of the D-shaped opening 30 is only slightly larger than the diameter of the screw shaft 38 so that horizontal movement of the hinge plate 28 is prevented.

In an assembly line for the production of furniture articles such as cabinets, the process begins by pre-mounting the improved adjustable hinge 10 on a door 20 by affixing the hinge cup 12 in a pre-drilled bore hole in the door. Also, a fastening screw 34 is pre-installed on the frame 32 by partially driving the screw shaft into the frame with the screw head and a portion of the screw shaft extending above the surface of the frame. Next, the substantially D-shaped opening 30 of the hinge plate 28 is positioned over the head of the fastening screw 34 and the hinge plate 28 is tilted relative to the screw head so that the screw head of the pre-installed fastening screw passes through the opening 30. Prior to tightening the fastening screw 34, the pre-mounted hinge plate 28 is shifted lengthwise along the D-shaped opening 30 to vertically align the door with the frame. Finally, the fastening screw 34 is tightened to securely affix the hinge plate 28 and supported door to the frame While specific embodiments and features of the invention have been disclosed herein, it will be readily understood that the invention encompasses all enhancements and modifications within the scope and spirit of the following claims.

What is claimed is:

1. A self mounting adjustable hinge for mounting a door on a frame having a pre-installed fastening screw, said hinge comprising:

a. a hinge cup mountable to a door;

b. a hinge arm connected at one end to the hinge cup;

c. a hinge plate formed at the other end of the hinge arm, said hinge plate having a substantially D-shaped opening in the hinge plate for receiving a pre-installed fastening screw.

2. The self mounting adjustable hinge as claimed in claim 1, said substantially D-shaped opening being dimensioned to allow a head of a pre-installed fastening screw to pass therethrough only when the hinge plate is tilted relative to the screw head and whereby tightening the fastening screw securely affixes the hinge plate to the frame.

3. The self mounting adjustable hinge as claimed in claim 2, said substantially D-shaped opening being dimensioned to allow adjustment of the hinge plate in the vertical direction prior to tightening the fastening screw.

4. An adjustable hinge for mounting a door member on a supporting frame, the supporting frame including a pre-installed fastening screw having a screw shaft and a screw head, wherein said fastening screw is partially driven into the frame with the head and a portion of the screw shaft extending above the surface of the frame, said adjustable hinge comprising:

a. a hinge cup mountable to the door member;

b. a hinge arm connected at one end to the hinge cup;

c. a hinge plate connected on the other end of the hinge arm, said hinge plate have a substantially D-shaped opening formed in the hinge plate adapted to receive therethrough the screw head of the pre-installed fastening screw.

5. The adjustable hinge as claimed in claim 4, wherein the width of said D-shaped opening is less than the diameter of the screw head and is slightly larger and substantially equal to the diameter of the shaft.

6. The adjustable hinge as claimed in claim 5, wherein said D-shaped opening is dimensioned to allow the screw head to pass therethrough only when the hinge plate is tilted relative to the screw head, whereby tightening the fastening screw securely affixes the hinge plate to the supporting frame.

7. The adjustable hinge as claimed in claim 6, wherein the length of the D-shaped opening is larger than the screw shaft, whereby the hinge plate is adjustable in a lengthwise direction for permitting vertical alignment of the door prior to tightening the fastening screw.

8. An adjustable hinge for mounting a door member on a supporting frame, the supporting frame including a pre-installed fastening screw having a screw shaft and a screw head, wherein said fastening screw is partially driven into the frame with the head and a portion of the screw shaft extending above the surface of the frame, said adjustable hinge comprising:

a. a hinge cup mountable to the door member;

b. a hinge arm connected at one end to the hinge cup;

c. a hinge plate connected on the other end of the hinge arm, said hinge plate have a substantially D-shaped slot formed in the hinge plate; and d. a pass through entry opening in the D-shaped slot, said entry opening defined by tilting the hinge plate relative to the screw head whereby the screw head of the pre-installed fastening screw passes therethrough.

9. The adjustable hinge as claimed in claim 8, said D-shaped slot having a width slightly larger and substantially equal to the diameter of the shaft of the fastening screw, wherein tightening the fastening screw securely affixes the hinge plate to the supporting frame.

10. The adjustable hinge as claimed in claim 9, wherein the length of the D-shaped opening is larger than the screw shaft, said hinge plate being adjustable in a lengthwise direction for permitting alignment of the door in a vertical direction prior to tightening the screw.

11. In an adjustable hinge having a hinge cup mountable to a door, a hinge arm connected at one end to the hinge cup and a hinge plate connected to the hinge arm at the other end, an improvement comprising a substantially D-shaped opening in the hinge plate for receiving a pre-installed fastening screw.

12. The improvement as claimed in claim 11, wherein the width of the D-shaped opening is less than the diameter of the head of the fastening screw and substantially equal to the diameter of the shaft, whereby tilting the hinge plate relative to the screw head allows the screw head of the pre-installed fastening screw to pass therethrough.

13. A method for mounting a door to a frame using an adjustable hinge, said hinge including a hinge cup, a hinge arm connected at one end to the hinge cup and a hinge plate connected to the other end of the hinge arm, said hinge plate having a substantially D-shaped opening, the method comprising the steps of:

a. pre-mounting the hinge on the door by affixing the hinge cup in a pre-drilled bore hole in the door;

b. pre-installing a fastening screw to the frame wherein said fastening screw is partially driven into the frame with the head and a portion of the screw shaft extending above the surface of the frame;

c. positioning and aligning the substantially D-shaped opening of the hinge plate over the head of the fastening screw;

d. tilting the hinge plate relative to the screw head whereby the screw head of the pre-installed fastening screw passes through the opening; and e. tightening the fastening screw to securely affix the hinge plate and supported door to the frame.

14. The method for mounting a door to a frame as claimed in claim 13, said method further comprising the step of shifting the hinge plate lengthwise along D-shaped opening to vertically align the door with the frame prior to tightening the fastening screw.

* * * * *